United States Patent [19]

Gernez

[11] 4,163,703

[45] Aug. 7, 1979

[54] METHOD OF COATING THE INSIDE SURFACE OF A HOLLOW BODY

[75] Inventor: Alain Gernez, Saint Jean de la Ruelle, France

[73] Assignee: Compagnie Europeenne pour l'Equipement Menager "CEPEM", Paris, France

[21] Appl. No.: 929,603

[22] Filed: Jul. 31, 1978

[30] Foreign Application Priority Data

Aug. 1, 1977 [FR] France ..... 77 23592

[51] Int. Cl.[2] ..... B01D 13/02; C25B 11/00; C25D 7/04; C25D 13/14

[52] U.S. Cl. ..... 204/181 R; 204/26; 204/286; 204/300 EC

[58] Field of Search ..... 204/181 R, 300 EC, 26, 204/286

[56] References Cited

U.S. PATENT DOCUMENTS 3,922,213 11/1975 Smith et al. ..... 204/181 R

*Primary Examiner*—Howard S. Williams

*Attorney, Agent, or Firm*—Sughrue, Rothwell, Mion, Zinn and Macpeak

[57] ABSTRACT

The method is particularly suitable for applying enamel by electrophoresis inside a hollow body, e.g. a sheet metal part. It consists in using an expandable cathode which, when expanded, approaches the interior angles of the hollow body, thereby favoring deposition of enamel in otherwise unfavored regions of the hollow body. Also, the expandable cathode is hollow and has a fluid flowing through it to drain off unwanted ions which could damage the enamel slip.

12 Claims, 5 Drawing Figures

METHOD OF COATING THE INSIDE SURFACE OF A HOLLOW BODY

FIELD OF THE INVENTION

The invention relates to a method of coating, e.g. applying enamel by electrophoresis, to the inside surface of a hollow body and to devices for applying this method.

BACKGROUND OF THE INVENTION

Enamel deposition by electrophoresis is an application of the principle of using an electric current to convey particles of enamel in an enamel slip (e.g. in suspension in water) from a cathode to the surface to be convered which acts as an anode. Particles are conveyed preferentially along the lines of an electric field. When these lines are not very dense, as in the case of internal angles of the hollow body, it is necessary to place the cathode as near as possible to the centre of the radius of curvature of the angle.

The disadvantage of known methods is that the interior corners of hollow sheet metal parts are not coated with a layer of enamel which is thick enough to protect the sheet metal base, especially as chemical attacks tend to occur at these points.

Preferred application of the invention remedies this disadvantage by applying a sufficient thickness of enamel to protect the sheet metal base in the interior corners of hollow parts, even if the internal radii of the rounded edges are very small.

An aim of the invention is to apply enamel to bodies of different dimensions using the same cathode of dimensions which adapt themselves to those of the various bodies.

Another aim of the invention is to apply enamel inside bodies whose opening is smaller than their average internal cross-section.

SUMMARY OF THE INVENTION

The present invention provides a method of coating the inside surface of a hollow body by means of an electric current established between the hollow body and an electrode inserted therein, wherein the electrode is expandable, so that after insertion into the hollow body the electrode may be expanded to bring it closer to the interior angles of the inside surface of the hollow body, and wherein the expandable electrode comprises a drainage electrode including a part of substantially tubular shape through which fluid flows during coating.

The present invention also provides an electrode for applying the method according to any preceding claim, wherein the electrode comprises extensible members installed on moveable members which bring the extensible members closer to the interior angles of the part to be enamelled. Each extensible member may comprise:

- a spring made of an inoxidizable material;
- an electrically conductive metal braid wound on the spring and surrounding the wire of the spring in a U configuration; and
- a woven membrane fixed on the spring and which provides electrodyalisis between the medium inside the electrode and the medium outside the electrode.

An embodiment of the invention is described hereinbelow by way of example with reference to the accompanying drawings.

DESCRIPTION OF PREFERRED EMBODIMENTS

Figure 1:
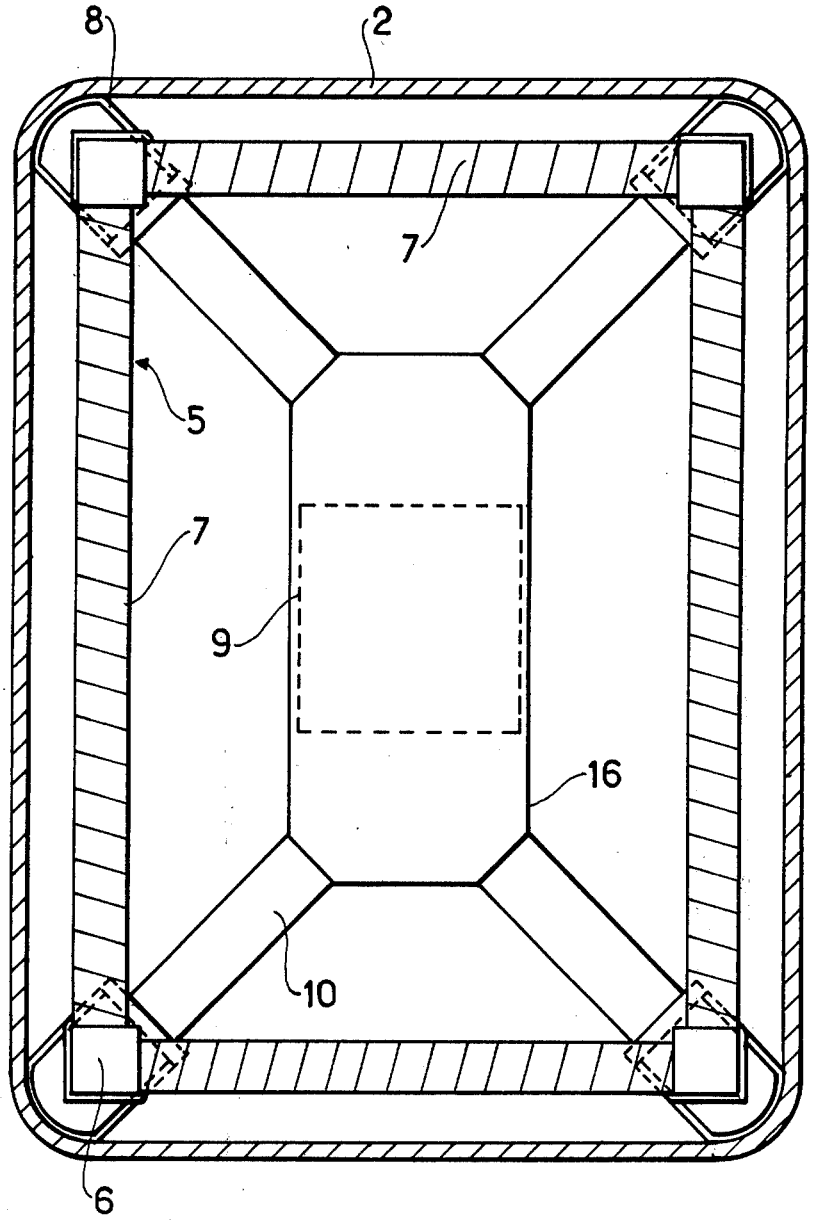
FIG. 1 is a plan view of an expandable cathode in its expanded position inside a tube which is to be enamelled.

In the embodiment shown, a hollow body 2 to be enamelled, for example the oven of a cooker, is immersed in the electrophoresis bath of a vat (not shown). A cathode assembly which includes stationary main cathodes 4 and expandable auxiliary cathodes 5 is disposed in the body 2 to be enamelled which acts an an anode. The stationary cathodes 4 are placed in the centre of the body so as to enamel its plane side surfaces. The expandable auxiliary cathodes 5 for enamelling the internal corners are placed near and parallel to the corners (i.e. the sides where two faces meet). The cathodes include undeformable movable cathodes 6 and extensible cathodes 7 which form a rectangle. The extensible cathodes 7 are in the form of four tubular members which are installed with their ends on the undeformable movable cathodes 6 which are in the form of horizontally movable perpendicular members. In its expanded position the assembly formed by the expandable cathodes 5 presses on the sheet metal to be enamelled by means of insulative parts 8 which form bumpers.

The cathodes constitute drainage tubes, i.e. a fluid flows through them to remove the hydrogen which is evolved at the cathode and substances with a highly basic pH generated round the cathode, which would make the enamel slip unfit for use.

FIG. 1 is a plan view of four expandable cathodes 7 fixed to the ends of the four undeformable, movable cathodes 6 which are moved by a flexible jack 9 which extends and retracts them by means of arms 10 constituted by rubber straps which include a rigid interior member so as to transmit both traction and thrust movements and which pivot on their ends.

Figure 2:
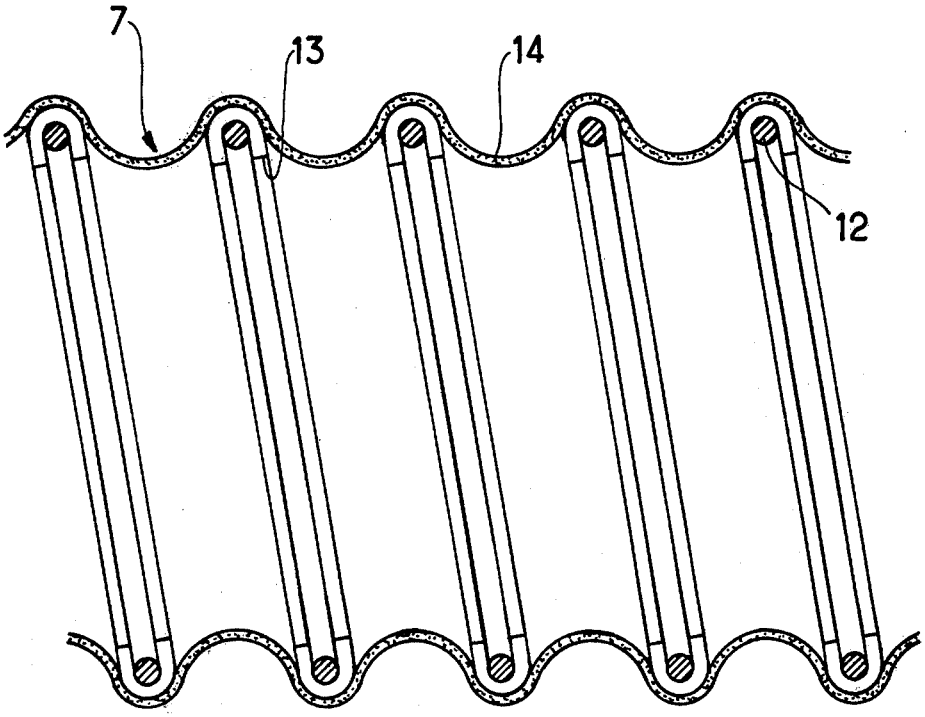
FIG. 2 is an enlarged partial view of the expandable cathode.

FIG. 2 shows the constitution of an extensible tubular cathode 7 on an enlarged scale. The main parts of this cathode 7 are:

a stainless steel spring 12 which imparts mechanical strength to a flat copper braid 13 of small cross-section which is folded in a U-shape and wound round the spring 12 along the turns and through which electric current passes; and a filtering fabric 14 constituted by a woven electrodialysis membrane stitched or tightly fitted on the spring. The fabric is made of acrylic resin known by the trade name of "Dralon". The fabric is made impermeable by an adhesive or by a product which is sensitive to light whereever a cathode is not required. The spring 12 keeps the extensible tubular member rectilinear and guides the fabric which thus retains its filtering properties.

The cathode thus assumes the shape of an expandable tube which can be lengthened or shortened by means of the pneumatic or hydraulic jack 9. This embodiment effectively guides the filtering fabric in all positions and provides optimum conduction of the current and very close contact between the cathode and the filtering fabric.

Figure 3:
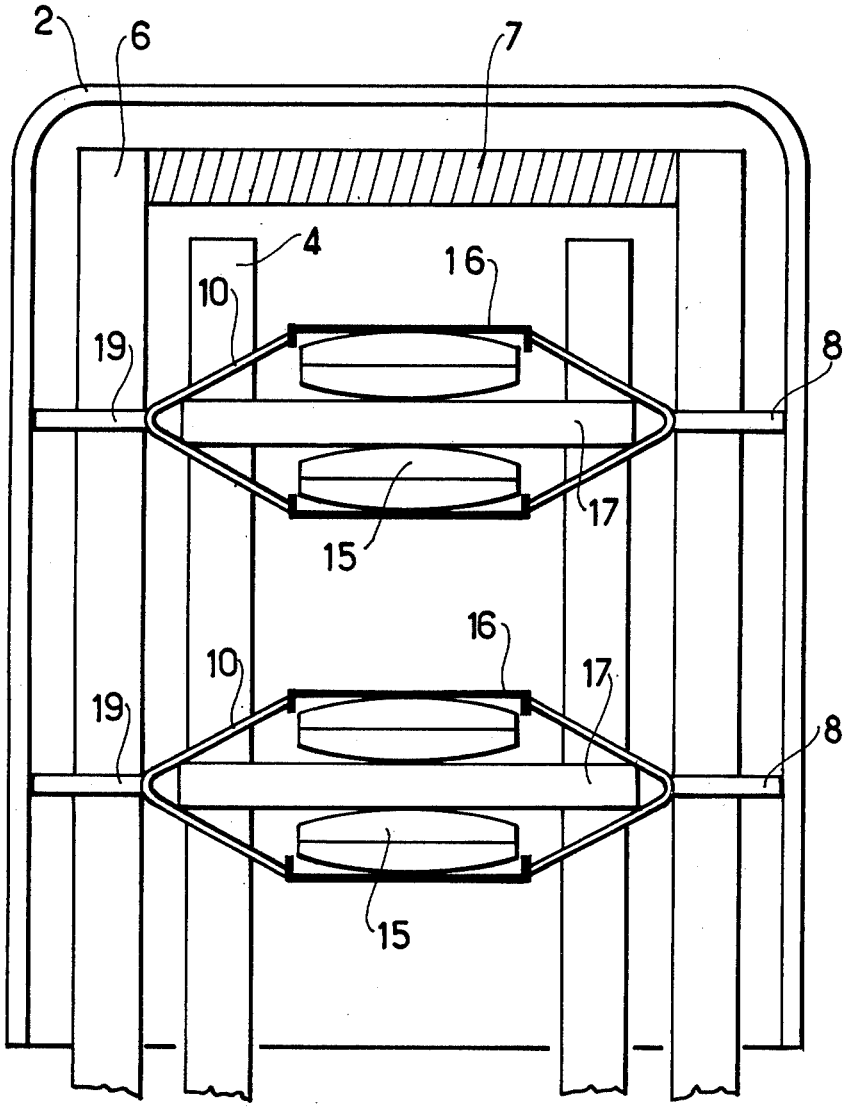
FIG. 3 is an elevation view of an expandable cathode in the expanded position, expanded by means of a pneumatic jack.
Figure 4:
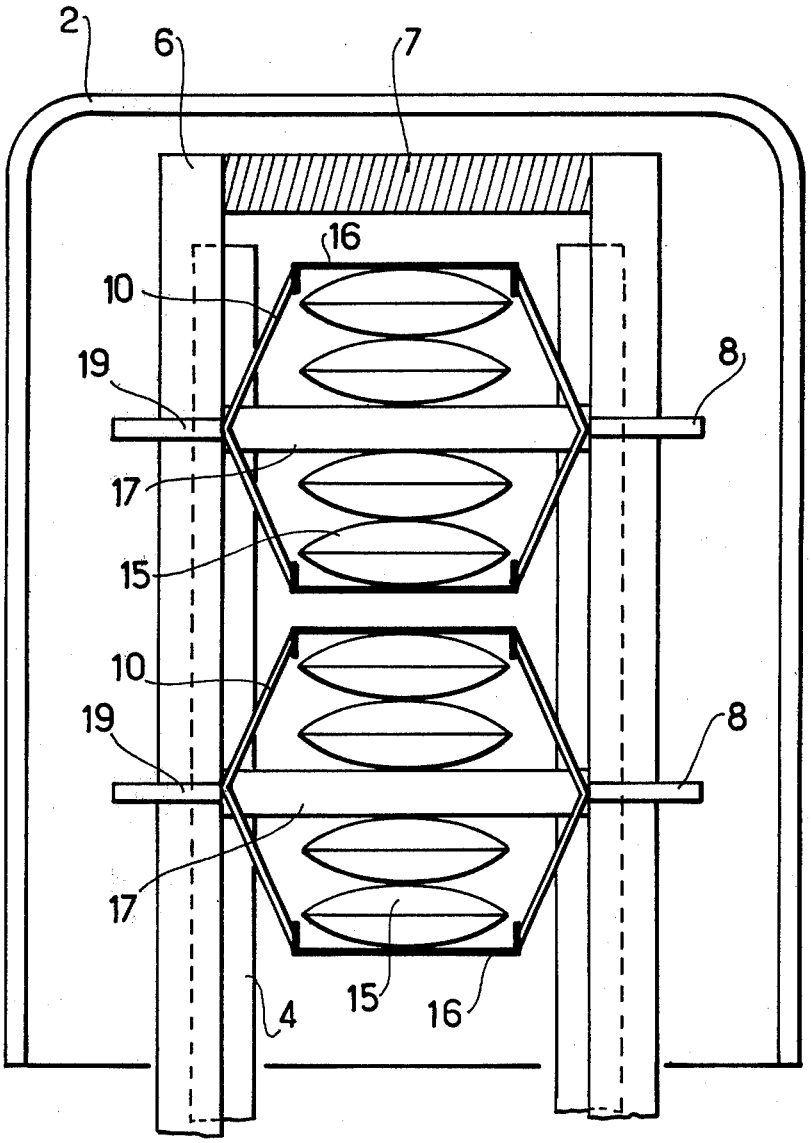
FIG. 4 is an analogous view to that of FIG. 3, with the cathode in the retracted position.

FIGS. 3 and 4 show an embodiment of the jacks. The jacks 9 include bags 15 which are supported by an insulative plate 17 fixed by screws on the stationary cathodes 4. When the bags 15 are inflated, they expand a casing 16 to which the straps 10 are fixed. These straps 10 are connected in pairs at their other ends to an insulative collar 19 fixed on the movable cathodes 6; this insulative collar ends in the insulative parts 8 which form bumpers between the cathode and the surface to be enamelled. When the casing expands, the cathodes retract and assume the position shown in FIG. 4. When the bags are deflated, the cathodes assume the expanded position of FIG. 3 under the effect of the straps 10. The invention provides flexible control means which cannot be attacked by the enamel slip. Since the expandable tubular cathodes thus formed are in groups of four with both their ends installed on the undeformable perpendicular movable cathodes, the expansion and retraction movements are simultaneous for the four deformable cathodes and for the four undeformable movable cathodes.

Figure 5:
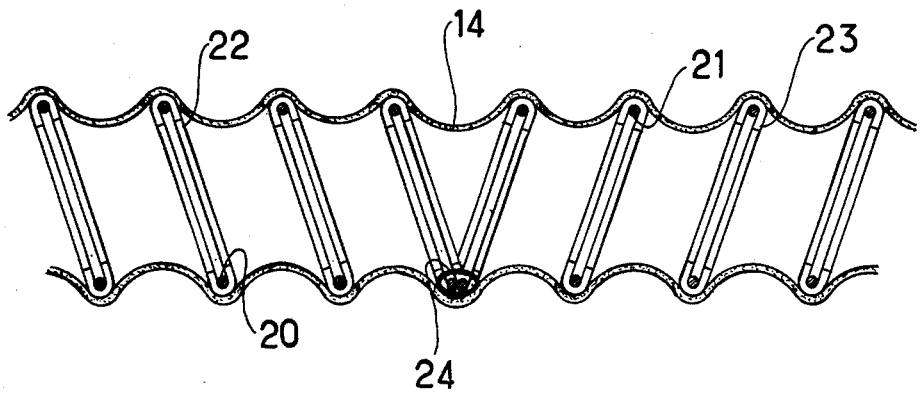
FIG. 5 is a sectional view shows a variant of the expandable cathode.

FIG. 5 shows a variant of the expandable cathode 7, which increases its lengthening factor. Instead of using a spring 12 with only one turn direction as in FIG. 2, two springs 20 and 21 are used one of which is right-handed and the other of which is left-handed. These springs are surrounded with braid 22 and 23 and are placed end to end, then they are connected by a conductive metal tube 24 threaded on one end of the braids and the springs. This tube 24 is then chrushed and the assembly thus constituted is engaged in the woven membrane 14.

In this embodiment, the central portion of the expandable cathode 7 turns on its axis when the undeformable cathodes 6 exert traction on them. This allows the expandable cathode to be lengthened more than it would be with a cathode which has only one spring with only one turn direction.

A hollow body is enamelled by means of an expandable cathode as follows:

the cathode is expanded until stopped by the insulative bumpers engaging the part to be enamelled;

electric current is passed between the cathode and the part;

the cathodes are rectracted while maintaining the current; and the current is turned off.

Using the following method:

in a first phase, a current is passed in the main cathodes and in the expanded auxiliary cathodes;

in a second phase, the current is passed in the expanded auxiliary cathodes for finishing; and in a third phase, the current is passed in the auxiliary cathodes in the retracted position, mainly during the retraction movement, so as to enamel the points where the bumpers were in contact with the body.

The advantages of the method described above are as follows:

The expandable cathodes 7 adapt themselves automatically to the shapes of various bodies. Even in the case of small bodies, the cathode can be expanded and applied against the surface which is to be enamelled by means of the insulative bumpers.

By this method, a layer of enamel is obtained which has no flaws even at the points where the insulative bumpers are applied, due to the fact that, a few seconds before the end of the operation, the cathodes are retracted so that there is no more contact with the body to be enamelled while the electric current continues to pass and finishes the enamelling on the non-enamelled portion. Enamelling is finished very rapidly by the lines of the electric field concentrating onto the small non-enamelled portions which have less electrical resistance than the enamelled portions.

The invention provides a flexible system without hinges which can be locked in position while current still passes through it.

The cathodes are continuous and hence a continuous layer of enamel is provided whose thickness is sufficient at all points.

The method described greatly automatizes the enamelling process by electrophoresis of hollow bodies and there is less need than previously for mechanical precision between the cathode and the part to be enamelled.

A sufficiently thick layer of enamel is applied in the internal angles of the hollow bodies even if the internal radii of the body are very small.

A layer of enamel can be applied on bodies of different sizes with a same expandable cathode whose dimensions adapt automatically to those of the bodies to be enamelled.

A layer of enamel can be applied inside bodies having an opening which is smaller than their average inside cross-section.

Unwanted ionized chemical substances are removed by electrodyalisis through the membrane which surrounds the cathodes.

The hydrogen which is evolved at the cathode and which could leave marks on the enamel is removed.

A preferred application of the invention is to the enamelling of hollows parts of electric household appliances such as cooking overs or the tubs of washing machines.

It must be understood that the invention is not limited to the embodiment described and illustrated and that without going beyond the scope of the invention, any means can be replaced by equivalent means and in particular for applying materials other than enamel and by methods other than electrophoresis. It is possible in some applications to interchange the anode and the cathode functions.

I claim:

1. A method of coating the inside surface of a hollow body having a curved interior by means of an electric current established between the hollow body and an electrode inserted therein, said method comprising the steps of:

expanding the electrode after insertion into the hollow body to bring it closer to the interior angles of the inside surface of the hollow body, said electrode comprising a drainage electrode including a part of substantially tubular shape, and wherein said method of coating further comprises the step of flowing fluid through said tubular shaped part during the application of electric current between said hollow body and said electrode.

2. A method according to claim 1 wherein the coating is an enamel coating.

3. A method according to claim 1, further comprising the step of applying the enamel coating by electrophoresis to said hollow body.

4. A method according to claim 1, wherein the hollow body is made of sheet metal.

5. A method according to claim 1, further comprising the step of stopping the expansion of the expandable electrode by insulative bumpers mounted on the expandable electrode which come into contact with the inside surface of the hollow body and wherein said method further comprises the step of retracting for a few instants, the electrode prior to termination of application of the electric current so as to complete the coating at the points at which the insulative bumpers were in contact with the hollow body inside surface.

6. An electrode for use in coating the inside surface of a hollow body by means of an electric current established between the hollow body and said electrode inserted within said hollow body, said electrode comprising extensible members installed on moveable members for bringing the extensible members closer to the interior angles of the body part to be enamelled, and wherein said expandable electrode further comprises a drainage electrode including a part of substantially tubular shape through which fluid flows during coating.

7. An electrode according to claim 6, wherein each extensible member comprises:

at least one spring made of an inoxidizable material;

an electrically conductive metal braid wound on the spring and surrounding the wire of the spring in a U configuration; and a woven membrane fixed on the spring and which provides electrodyalisis between the medium inside the electrode and the medium outside the electrode.

8. An electrode according to claim 7, wherein said at least one spring comprises two springs of opposite handedness, each spring being surrounded by braid, one of said springs being placed end to end with the other spring and being connected thereto by a crushed metal tube, the whole being engaged inside the woven membrane.

9. An electrode according to claim 6, wherein the electrode is constituted by four extensible members arranged in a horizontally extending rectangle, the corners of the rectangle being installed on the movable members which are constituted by substantially undeformable posts arranged for horizontal movement.

10. An electrode according to claim 6, wherein the electrode is expanded and retracted by a flexible jack including an inflatable casing.

11. An electrode according to claim 10, wherein the inflatable casing includes inflatable bags.

12. An electrode according to claim 10 wherein the flexible jack is connected by arms to the movable members to move them in parallel translation.

* * * * *